US008110769B2

(12) United States Patent
Bodenstein et al.

(10) Patent No.: US 8,110,769 B2
(45) Date of Patent: Feb. 7, 2012

(54) VACUUM CIRCUIT BREAKER

(75) Inventors: Klaus Bodenstein, Voerde (DE); Detlef Lange, Oberhausen (DE)

(73) Assignee: Switchcraft Europe GmbH, Dinslaken (DE)

( * ) Notice: Subject to any disclaimer, the term of this patent is extended or adjusted under 35 U.S.C. 154(b) by 422 days.

(21) Appl. No.: 12/440,383

(22) PCT Filed: Sep. 7, 2007

(86) PCT No.: PCT/EP2007/007821
§ 371 (c)(1),
(2), (4) Date: Apr. 30, 2009

(87) PCT Pub. No.: WO2008/028672
PCT Pub. Date: Mar. 13, 2008

(65) Prior Publication Data

US 2010/0025375 A1 Feb. 4, 2010

(30) Foreign Application Priority Data

Sep. 7, 2006 (DE) ..... 10 2006 042 101

(51) Int. Cl.
*H01H 33/66* (2006.01)

(52) U.S. Cl. ..... 218/124; 218/10; 218/146

(58) Field of Classification Search ..... 218/10, 218/124, 146
See application file for complete search history.

(56) References Cited

U.S. PATENT DOCUMENTS 3,239,635 A 3/1966 Baude
4,153,827 A 5/1979 Microvich et al.
4,420,661 A 12/1983 Efinger et al.
5,206,616 A * 4/1993 Stegmuller ..... 335/126
5,387,772 A 2/1995 Bestel
5,530,216 A 6/1996 Benke et al.
(Continued)

FOREIGN PATENT DOCUMENTS

DE 4329349 A1 3/1995
(Continued)

OTHER PUBLICATIONS

International Search Report of PCT/EP2007/007821 mailed Jan. 18, 2009.

(Continued)

*Primary Examiner* — Truc Nguyen
(74) *Attorney, Agent, or Firm* — Alston & Bird LLP

(57) ABSTRACT

The invention relates to a vacuum switch, especially a vacuum circuit breaker, for medium and high voltages, comprising a mobile switch unit arranged inside a vacuum switch compartment (1) and provided with mutually mobile elements including a contact tappet (17), an insulator (18), and a driving or switching rod (11) introduced into the vacuum switch compartment (1) by means of metal bellows. Said vacuum switch also comprises a fixed contact inserted into the housing of the vacuum switch compartment (1). The upper end of the insulator (18) is fixed to the contact tappet (17), and the lower end of the insulator (18) is fixed to the driving or switching rod (11). The contact tappet (17) is connected to a conductor (8) by a flexible, electroconductive connection (20), said conductor being electroconductively connected to at least one laterally arranged output contact (6). The aim of the invention is to enable an improved embodiment of the switching and contact surfaces. To this end, the fixed contact (16) and the contact tappet (17) respectively comprise a switching contact part (14*a*, 14*b*) comprising an outer switching and contact surface (29) and an inner switching and contact surface (30) that can be moved in relation to the outer surface.

7 Claims, 6 Drawing Sheets

U.S. PATENT DOCUMENTS

Figure 1:
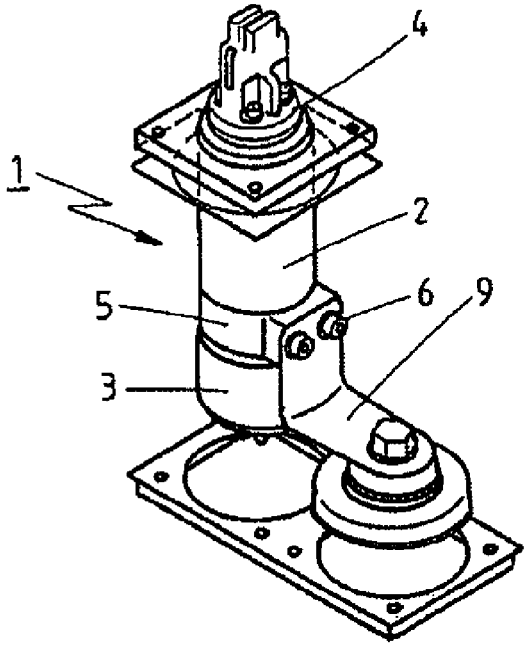

| | | | | |
|---|---|---|---|---|
| 5,663,544 | A * | 9/1997 | Niemeyer | 218/3 |
| 7,906,742 | B2 * | 3/2011 | Steffens et al. | 218/126 |
| 2002/0043516 | A1 | 4/2002 | Morita et al. | |

FOREIGN PATENT DOCUMENTS

| | | | |
|---|---|---|---|
| DE | 19505370 | C2 | 8/1996 |
| DE | 19712182 | A1 | 9/1998 |
| DE | 199 64 249 | C2 | 11/2002 |
| DE | 60013673 | T2 | 9/2005 |
| FR | 2 339 243 | | 8/1977 |
| GB | 1 212 657 | A | 11/1970 |
| JP | 2005197128 | A | 7/2005 |
| JP | 2005197129 | A | 7/2005 |
| WO | WO9001788 | A1 | 2/1990 |
| WO | WO9512889 | A1 | 5/1995 |

OTHER PUBLICATIONS

Written Opinion of PCT/EP2007/007821 mailed Jan. 18, 2009.
English Translation of Jan. 18, 2009 Written Opinion of PCT/EP2007/007821, previously cited in German.

* cited by examiner

VACUUM CIRCUIT BREAKER

The invention relates to a vacuum switch, in particular a vacuum circuit breaker, for medium voltage and high voltage, having a moving switching unit which is arranged within a vacuum interrupter chamber and comprises a contact plunger, an insulator and a drive or switching rod which move with one another, which drive or switching rod is introduced into the vacuum interrupter chamber through a bellows composed of metal, and having a stationary contact which is inserted into the housing of the vacuum interrupter chamber, with the upper end of the insulator being firmly connected to the contact plunger and with the lower end of the insulator being firmly connected to the drive or switching rod, and with the contact plunger having a conductive connection to a conductor which makes an electrically conductive connection to at one least one outgoer contact which is arranged at the side.

Circuit breakers offer the capability to disconnect existing electrical connections with the capability to switch electric currents of up to 160 kA. By way of example, these currents occur when a short circuit or a ground fault occurs in high-voltage power supply systems. Circuit breakers can not only switch normal operating currents and minor overload currents in the same way as switch disconnectors, but can also disconnect high overload currents and extremely high short-circuit currents. As an overcurrent protective device with a very high switching capability in the range from 80 kA-160 kA, they can switch equipment or installation parts both in the fault-free state and, for limited times, in the faulty state, for example in the event of a short circuit. Circuit breaker types include not only compressed-gas switches and flow switches but also vacuum switches. In vacuum switches, the contacts are in a vacuum, in order to prevent an arc.

DE 100 24 356 C1 discloses a gas-insulated switchgear assembly having vacuum switches, in which three circuit breakers in the form of vacuum switches are arranged within a vessel, which is filled with insulating gas, of the gas-insulated switchgear assembly. Each vacuum switch comprises a vacuum interrupter chamber, which is in the form of a vacuum area. A stationary contact plunger and a moving contact plunger are arranged within the vacuum area or this vacuum interrupter chamber and their respective contact rods are passed out of the vacuum area of the vacuum interrupter chamber. In this case, the contact rod of the moving contact plunger is passed through a bellows out of the vacuum area or the vacuum interrupter chamber. Outside the vacuum interrupter chamber, this plunger is connected to a power connection mount, and an operating device is provided in order to operate the switching rod of the moving contact plunger. The isolation capability of vacuum switches such as these does not just have to ensure the required isolation capability of the switch gap and isolation gap but also has to ensure that leakage currents or surface currents, when the isolation gap is in the open state, do not flow from the upper connection of the vacuum interrupter chamber to the lower connection, the connected power connection mount. In order to ensure this, appropriate separations are required between the connections, and the vacuum switch must be arranged within a vessel which is filled with insulting gas. This leads to vacuum switches, and switchgear assemblies fitted with them, being physically large.

It is also known that arc quenching within a vacuum interrupter chamber of a vacuum switch in a vacuum requires the use of the magnetic field which accompanies the electric current. The movement of the arc which is forced to occur under the influence of the magnetic field is dependent on a flat contact surface of the switching contact pieces of the stationary contact and contact plunger which are arranged within the vacuum interrupter chamber of the vacuum switch. Known switching contact pieces touch one another completely with their circular end surface under the influence of an external force when the isolation gap is closed. This contact force results essentially from the force which is applied by a spring associated with the external drive. In order to influence the strength and the direction of the magnetic field which accompanies the current, the switching contact pieces have internal recesses which induce an axial or vertical magnetic field, depending on their direction. The switching contact, which moves in the longitudinal direction, of the contact plunger is moved at high speed during a connection process and then impacts with the switching contact of the stationary contact, striking it repeatedly at a frequency which corresponds to the drive system and the moving mass. During the operating times of the vacuum switch, this impact leads firstly to mechanical oscillations which place major loads on the metal bellows through which the moving contact plunger is passed out of the vacuum chamber. There is a risk of cracks occurring after a certain number of switching operations, and these then lead to a breakdown of the vacuum in the vacuum chamber. The impact of the switching contact of the moving contact plunger with repeated striking movements also results, however, in repeated formation of a connection arc during a connection process. This leads to overheating of the material on the flat contact surfaces and thus to a plurality of local worn spots on the end contacts. During a disconnection process, the welded points on the end contacts are torn open by the force of the disconnection drive. In this case, there is then a risk of sharp-edged spikes being formed which considerably reduce the homogeneity of the electrical field on the contact surfaces of the end contacts, and thus the breakdown voltage between the open end contacts.

In order, if appropriate, to make it possible to limit the use of insulating gas, it is also known for the outgoer contact and the power connection mount to be arranged with an electrically conductive connection to the load conductor in or on the vacuum chamber of the vacuum interrupter chamber, and to be conductively connected via a flexible conductor to the contact plunger, which moves in the vacuum interrupter chamber. In this case, furthermore, the moving contact plunger which is arranged in the vacuum interrupter chamber is connected via an insulator to a drive or switching rod which is passed out of the vacuum interrupter chamber. One such vacuum switch of this generic type is known from DE 199 64 249 C2. These switches are subject to the problem that the conductive connection which produces the electrically conductive flexible connection between the moving contact plunger and the load conductor or the outgoer contact must be flexible in order to allow it to follow the longitudinal axial movement of the moving contact plunger during a connection and a disconnection process. This required flexibility must be ensured over a long time period and a large number of switching operations for the vacuum switch to have an adequate life. DE 199 64 249 C2 discloses a conductive connection being formed by means of a plurality of thin copper film foils which lie one on top of the other in the form of layers. This leads to the problem that oxide layers are formed in the vacuum, which stick to one another and, over time, prevent the flexibility of the conductive connection. In order to solve this problem, DE 199 64 249 C2 proposes that the conductive connection be formed by the alternating layer structure of conductor metal layers and adhesion prevention layers or that conductive connections be arranged in a protected area within the vacuum interrupter chamber in such a way that arc products which are created when an arc occurs cannot be precipitated on the flexible conductive connection.

This embodiment has the disadvantage that it is either necessary to provide a further housing within the vacuum interrupter chamber, in which the conductive connection is arranged in a protected manner, resulting in a considerable increase in the assembly effort, or else a complex design of the conductive connection is required in that an adhesion prevention layer must be provided alternately with a conductive layer.

The invention is based on the object of creating a solution which allows a better switching and contact-surface design.

In the case of a vacuum switch of the type referred to initially, this object is achieved according to the invention in that the stationary contact and the contact plunger each have a switching contact piece, which has an outer switching and contact surface and an inner switching and contact surface which can move relative thereto. Refinements and developments of the invention are specified in the dependent claims.

The invention creates a better switching and contact surface design for the switching contacts of a vacuum switch, which improves the life of the switching and contact surfaces and therefore that of the switching contact pieces which have these surfaces. The design of the outer and inner switching and contact surfaces and their capability to move relative to one another means that it is possible, when the switching contact pieces are being moved apart from one another in order to form an isolation gap, for the inner switching and contact surfaces of the stationary contact and moving contact plunger to be kept conductively connected to one another until the outer switching and contact surfaces of the respective switching contact pieces have moved apart from one another to such an extent that any arc which is created or occurs can no longer jump over onto these outer switching and contact surfaces. As the inner switching and contact surfaces move further apart from one another as well, the arc is now formed only between them. They are therefore designed to have a correspondingly high strength, and to be resistant to wear and erosion, as a result of which they are designed to have a sufficiently long life. In contrast, the surfaces of the outer switching and contact surfaces are designed to be highly conductive since they have to carry only the rated current. Particularly suitable materials for the outer switching and contact surfaces are copper-silver alloys, and copper-chromium alloys are particularly suitable material for the inner switching and contact surfaces.

One development of the invention comprises electrically conductive supporting heads which support the inner switching and contact surface being arranged like a spiral. This embodiment makes it possible to form an axial magnetic field in which even relative large arcs may be in the form of diffused arcs.

Figure 2:
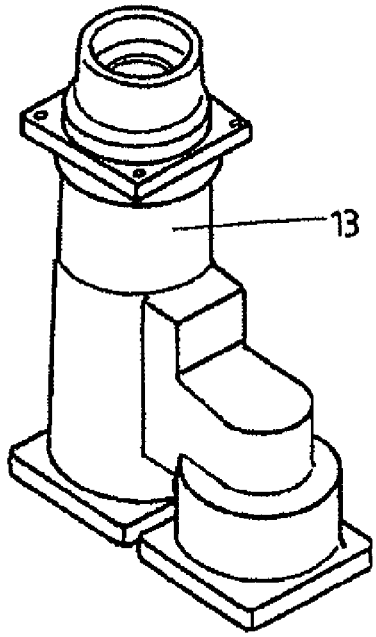
Figure 6:
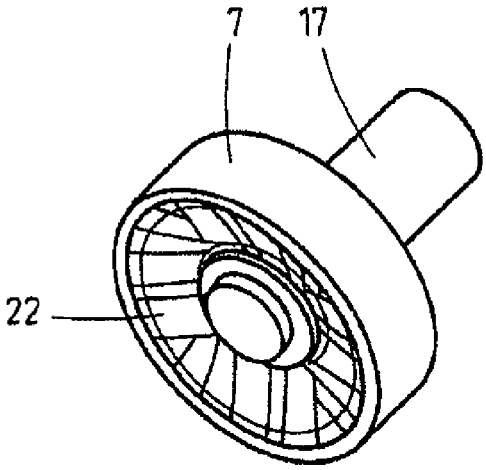
Figure 7:
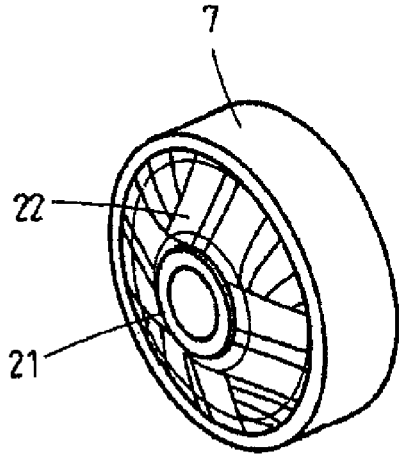
Figure 3:
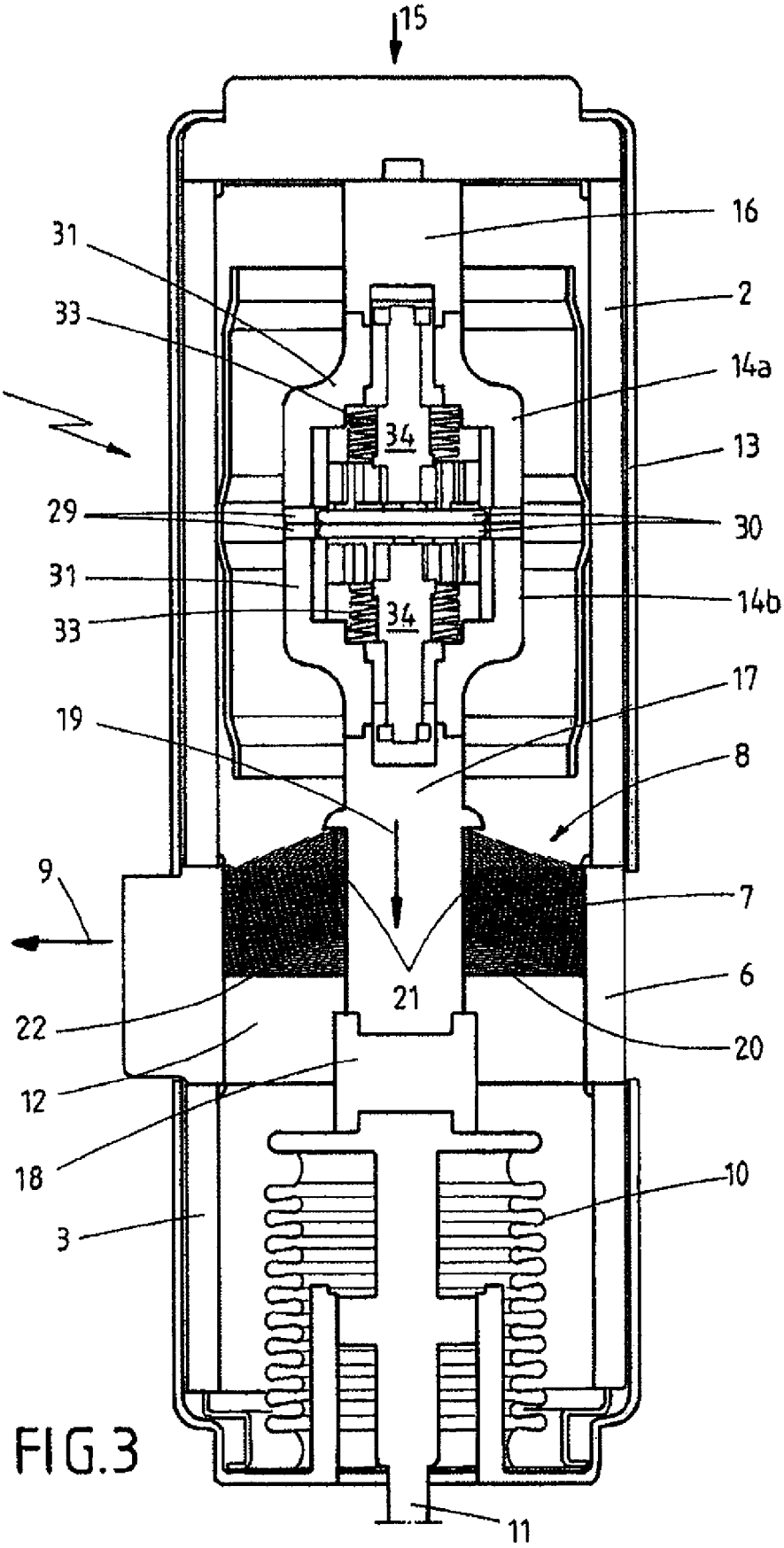
Figure 4:
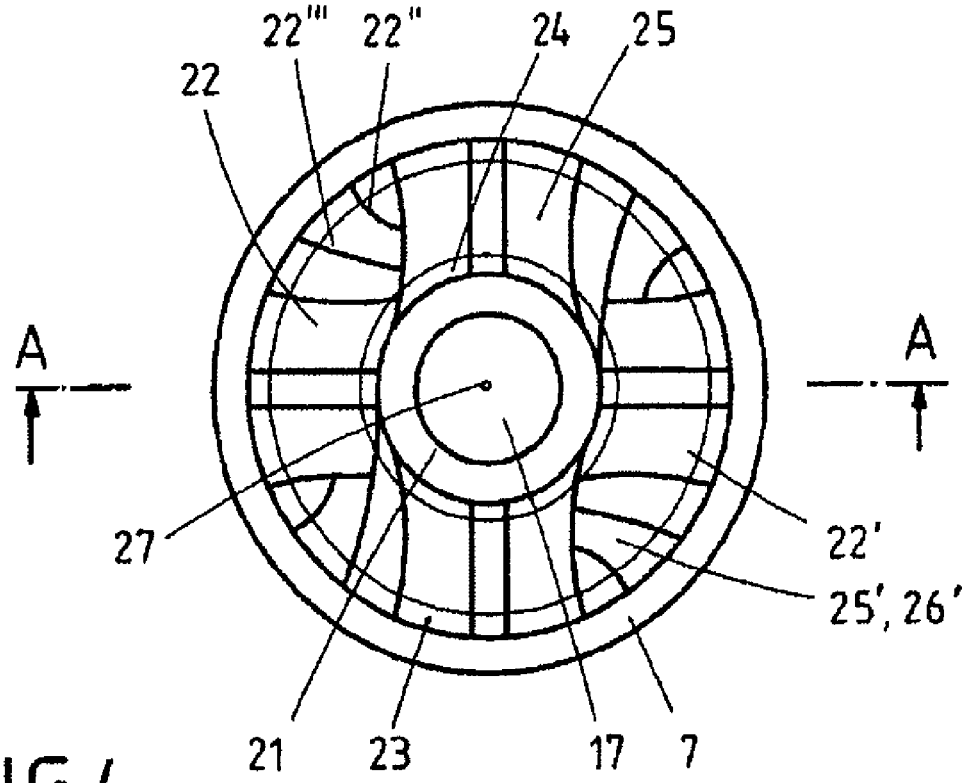
Figure 5:
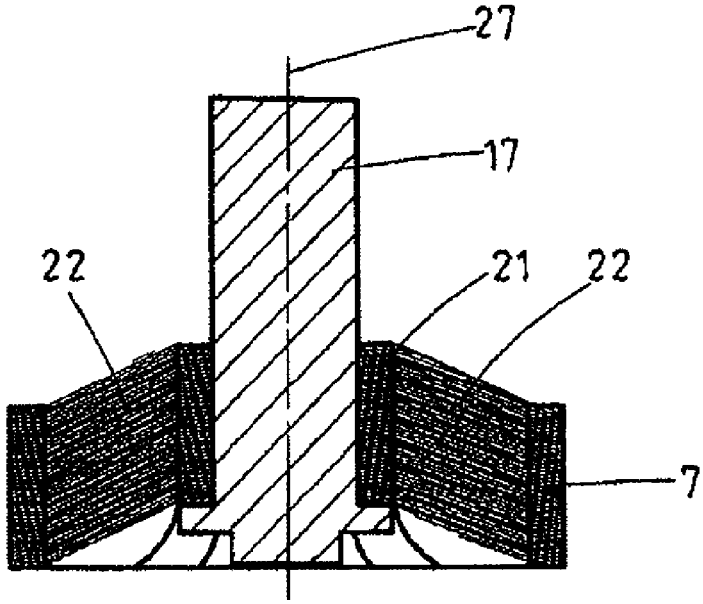
Figure 8:
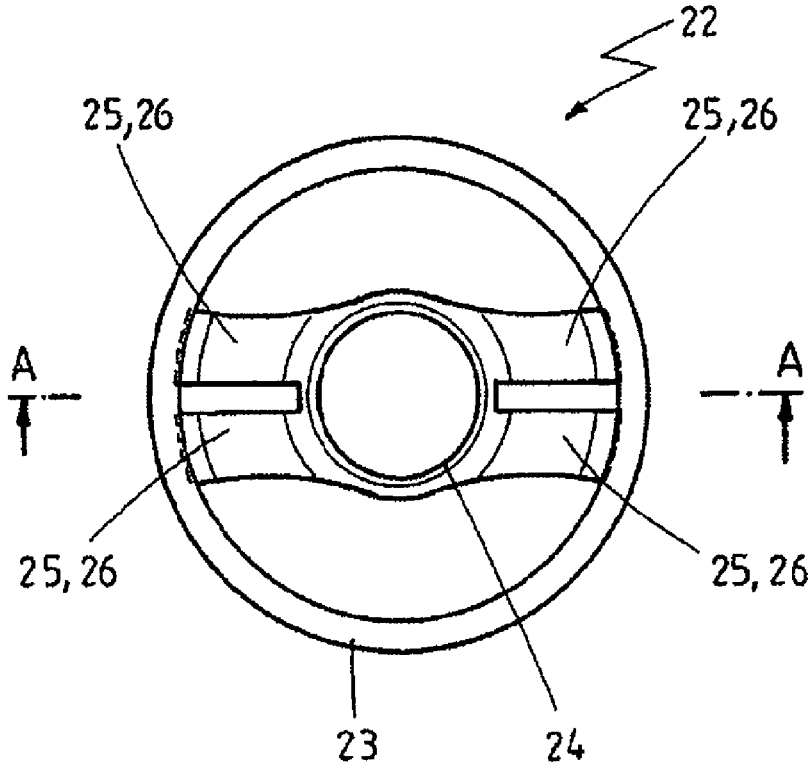
Figure 9:
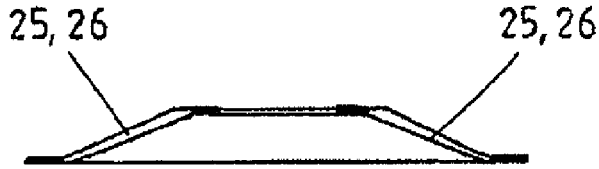
Figure 10:
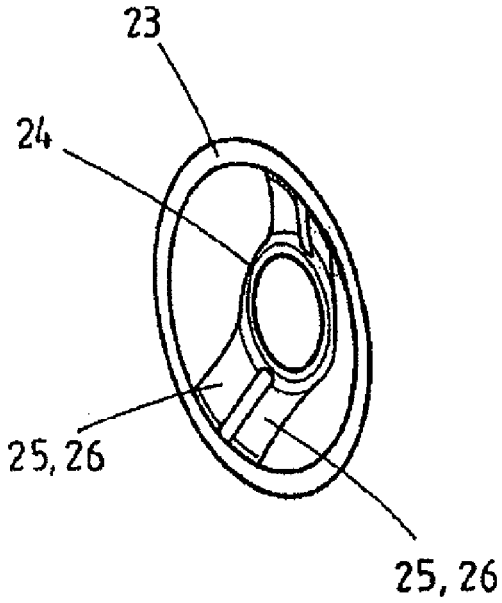
Figure 11:
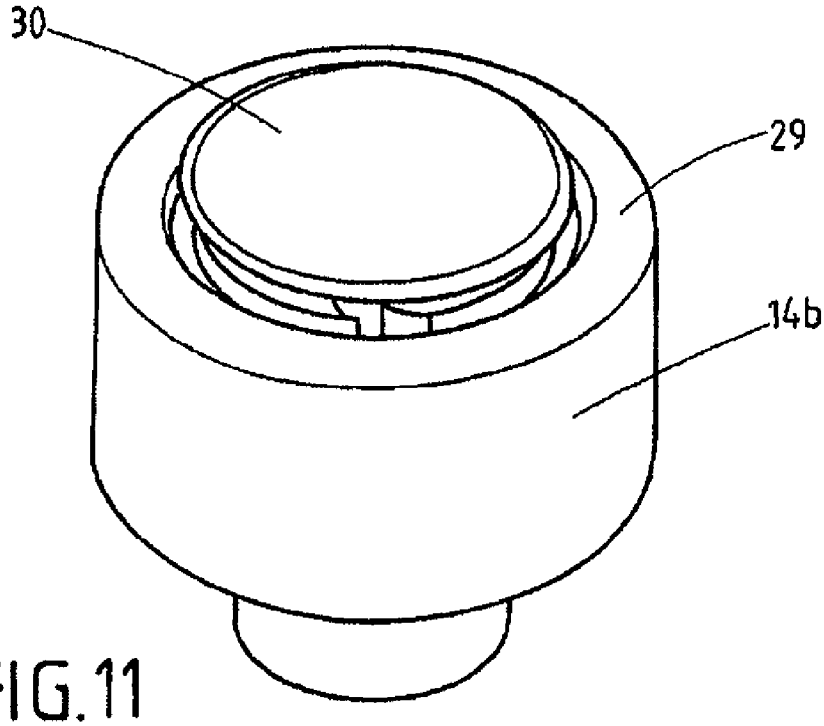
Figure 12:
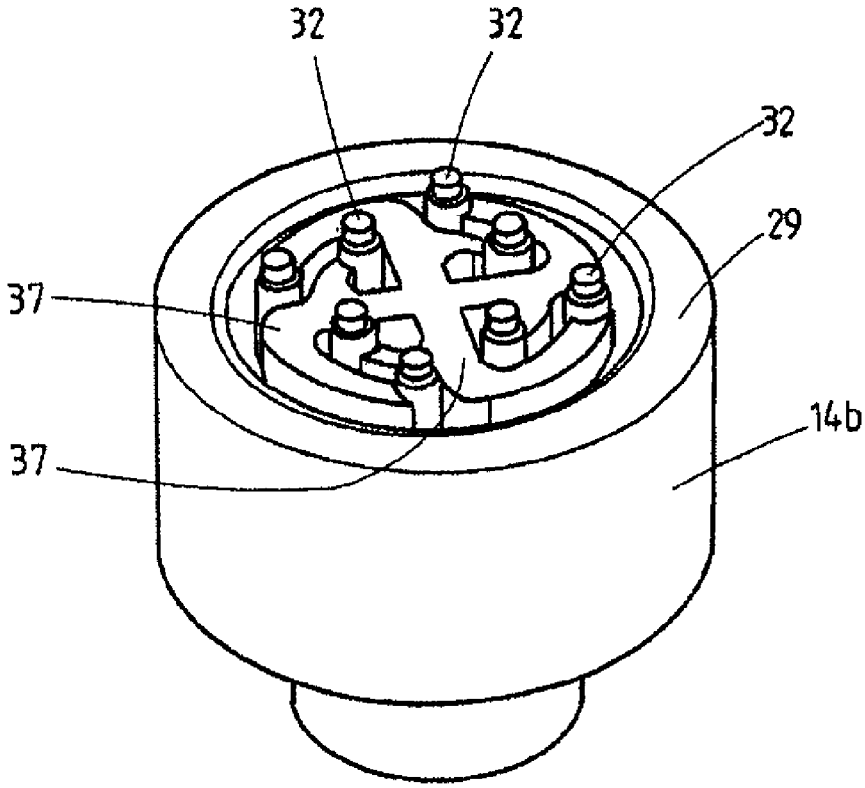
Figure 13:
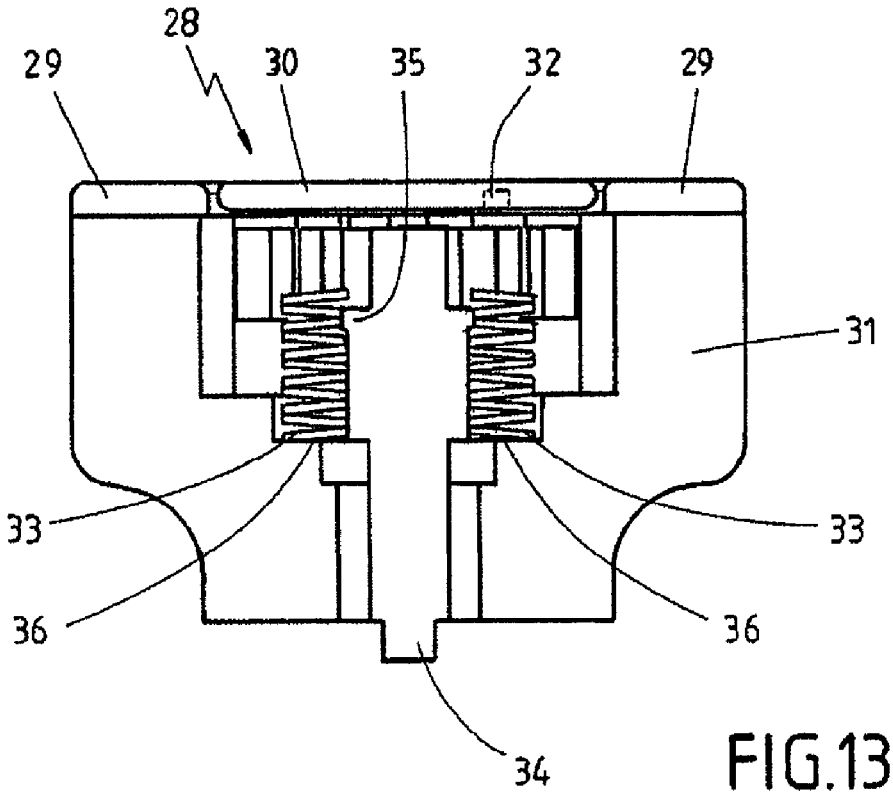
Figure 14:
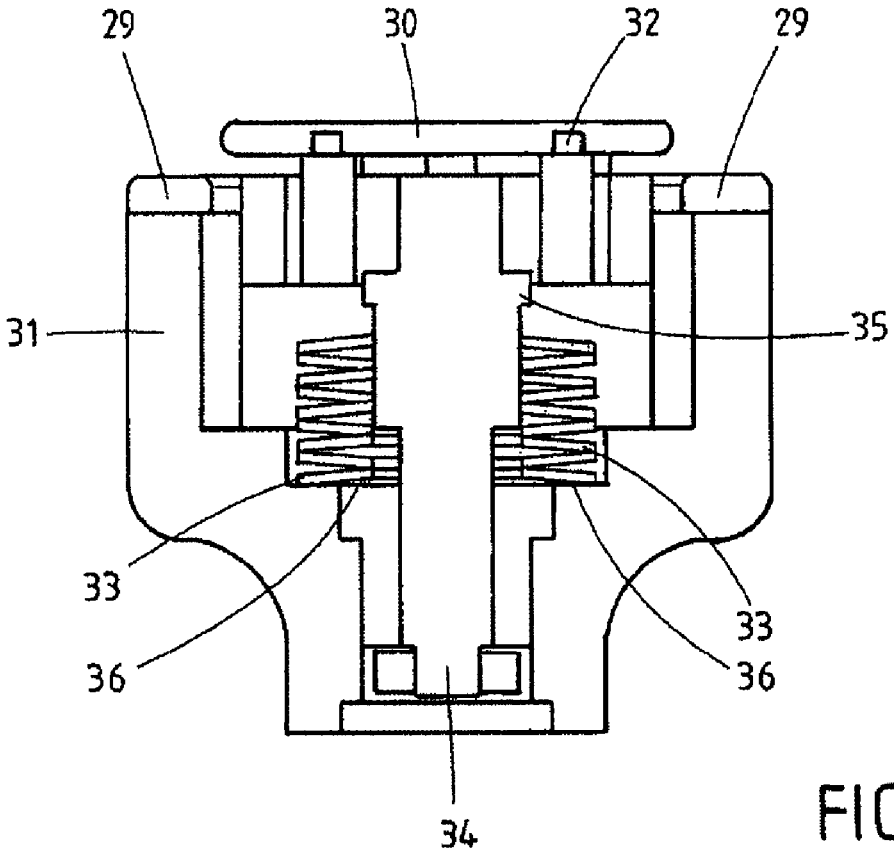

FIG. 1 shows a schematic perspective illustration of an external view of the vacuum switch according to the invention, FIG. 2 shows the vacuum switch as shown in FIG. 1 after fitting of an outer, sheathing casting-resin layer in order to form a casting-resin housing, FIG. 3 shows a longitudinal section through the vacuum interrupter chamber of the vacuum switch, FIG. 4 shows a plan view of a conductive connection, FIG. 5 shows a schematic illustration of a section along the axis A-A in FIG. 4, FIG. 6 shows a perspective view of the conductive connection, viewed from underneath, FIG. 7 shows a schematic view of the conductive connection, viewed from above, FIG. 8 shows a plan view of a connecting element, FIG. 9 shows a section through the connecting element along the line B-B in FIG. 8, FIG. 10 shows the connecting element as shown in FIGS. 8 and 9, in the form of a perspective view from above, FIG. 11 shows a perspective illustration of a switching contact piece of a stationary contact and/or of a contact plunger, FIG. 12 shows the switching contact piece as shown in FIG. 11, looking through the inner switching and contact surface, FIG. 13 shows a schematic illustration of a section through the switching contact piece as shown in FIGS. 11 and 12 with the inner switching and contact surface moved in, and FIG. 14 shows a schematic illustration of the switching contact piece as shown in FIG. 13, with the inner switching and contact surface moved out.

FIG. 1 shows a perspective illustration of the vacuum interrupter chamber 1 of a vacuum switch which comprises an upper gas-tight ceramic cylinder 2 and a lower gas-tight ceramic cylinder 3. The upper ceramic cylinder 2 is closed by a connecting cover 4. A contact ring 5 is formed between the upper ceramic cylinder 2 and the lower ceramic cylinder 3. The contact ring 5 has outgoer contacts 6 via which a ring 7 of a conductor 8 is electrically conductively connected to a load conductor 9. A drive or switching rod 11 is introduced in a vacuum-tight manner into the interior of the vacuum interrupter chamber 1 with the aid of a bellows 10 composed of metal. The internal area in the vacuum interrupter chamber 1 thus forms a vacuum chamber 12 in which a hard vacuum of $10^{-7}$ to $10^{-9}$ Torr or $10^{-7}$ to $10^{-9}$ mbar is formed. On the outside, the completely assembled vacuum interrupter chamber 1 of the vacuum switch is surrounded by a casting-resin jacket 13 or a casting-resin housing, as can be seen in FIG. 2.

FIG. 3 shows a schematic section view of the vacuum chamber 12 of the vacuum interrupter chamber 1 with the switching contact pieces 14*a*, 14*b* in the closed position, that is to say with an electrically conductive connection from a production line conductor 15, which is not illustrated in any more detail, through a stationary contact 16 and a moving contact plunger 17 as well as the conductor 8 and the outgoer contact 6, through the vacuum chamber 12, to the load conductor 9. In this position, no isolation gap is formed. By movement of the moving contact plunger 17 by means of the drive or switching rod 11, which is coupled via a ceramic insulator 18, in the direction of the arrow 19, the switching contact pieces 14*a*, 14*b* can be moved so far apart from one another that a gap is formed between them, which then forms an isolation gap.

The illustrated vacuum switch is a vacuum switch for medium voltage and high voltage. In this case, a moving switching unit is formed within the vacuum interrupter chamber 1, comprising the lower switching contact piece 14*b*, the contact plunger 17 which is arranged fixed on it, the insulator 18 which is arranged fixed on it, and the drive or switching rod 11. A flexible electrically conductive connection 20 to a conductor 8, or to form a conductor 8, is arranged on this moving switching unit, at the level of the outgoer contacts 6 or of the contact ring 5 or power connection mount on the contact plunger 17. The electrical current flow to the load conductor 9 is provided via this conductive connection 20, in such a way that an electrically conductive connection exists via this to at least one of the outgoer contacts 6.

The conductor 8 comprises a ring 7 which is arranged in a fixed position on the inside of the contact ring 5. Furthermore, the conductor 8 comprises a plunger ring 21 whose inner surface is arranged, preferably in a fixed position, on the external circumference of the contact plunger 17. The plunger ring 21 and the ring 7 are connected to one another via a multiplicity of connecting elements 22.

FIG. 8 shows a plan view of a single connecting element 22 which comprises an outer ring 23 and an inner ring 24, as well as four supporting elements 25, which connect the outer ring 23 and the inner ring 24 to one another, with the outer ring 23, the inner ring 24 and the supporting elements 25 being composed of an electrically conductive material which is like a film or platelet. As can be seen from FIGS. 9 and 10, the supporting elements 25 form covering elements 26 which rise from the outer ring 23 toward the inner ring 24, such that they cover the internal area of the outer ring 23 from one side to the diametrically opposite side in the form of an arc, including the inner ring 24.

As can be seen from the plan view in FIG. 4, which illustrates a plan view from above looking in the direction of the longitudinal axis 26 of the contact plunger 17, a multiplicity of connecting elements 22, 22', 22", 22''' are arranged one above the other in the direction of the axis 26, clamped in between the plunger ring 21 and the ring 7. In this case, the connecting elements 22, 22', 22", 22''' which are in each case located one on top of the other are each arranged offset through 10-15 degrees with respect to one another in the rotation direction around the axis 26, as a result of which all of these connecting elements 22, with all of their respective covering elements 26, 26' or supporting elements 25, 25', overall cover the area of the annular surface which is formed between the ring 7 and the plunger ring 21. In consequence, however, this also means that the entire free inner annular cross-sectional area of the vacuum chamber 12 or of the vacuum interrupter chamber 1 is covered over its entire area by the covering elements 26 of the connecting elements 22. Because the covering elements are located one on top of the other in layers, each offset through 10-15°, these are each covered by a subarea of their supporting elements 25. The connecting elements 22 therefore form the flexible part of the conductive connection 20 and, together with the ring 7 and the plunger ring 21, form the conductor 8, overall. As can be seen from FIG. 5, the connecting elements 22 with their outer ring 23 are each arranged in a fixed position in the ring 7, and are each arranged with their inner ring 24 in a fixed position in the plunger ring 21, with a gap being provided in the longitudinal axial direction between the respective individual connecting elements 22 which are arranged one on top of the other, such that an air or gas-area connection exists all the way through the connecting elements 22 with their covering elements 26 and supporting elements 25 while, on the other hand, these connecting elements 22 form a cover, which cannot be seen through, in a plan view as shown in FIG. 4. In the assembled position, this at this stage results in the positioning, as illustrated in FIG. 3 and corresponding to the closed position of the switching contact pieces 14*a*, 14*b*, of the connecting elements 22 with the lower face, which has a concave shape as can be seen in FIG. 6, and the upper face, which has a convex shape as can be seen in FIG. 7. The covering elements 26 and the supporting elements 25 are designed to be flexible such that they also follow the movement of the contact plunger 17 during the individual switching processes from the closed switching position to the open disconnected position, and back again.

The upper switching contact piece 14*a*, which is firmly connected to the stationary contact 16, and the lower switching contact piece 14*b*, which is firmly connected to the moving contact plunger 17, are each designed to be identical, as a result of which only the lower switching contact piece 14*b*, which is illustrated in FIGS. 11-14, will be explained in the description in the following text. Each switching contact piece 14*a*, 14*b* has a contact and switching surface 28 which is split in two and comprises an annular outer switching and contact surface 29 and an annular inner switching and contact surface 30. The outer switching and contact surface 29 is arranged in a fixed position on a mount body 31 of the respective switching contact piece 14*a*, 14*b*, and the inner switching and contact surface 30 is arranged on supporting heads 32, such that it can move relative to the outer switching and contact surface 29. Furthermore, an inner stamp or inner plunger 34, which can move in the direction of the axis 27 of the moving contact plunger 17 with the aid of the force of springs 33, acts on the inside of the inner switching and contact surface 30. One end of springs 33 is arranged on a base surface 36 in the base body or mount body 31, with their other ends resting on a stop ring 35 of the inner plunger 34. When the inner switching and contact surface 30 is in the moved-in position as illustrated in FIG. 13, the switching and contact surfaces 29, 30 of the upper switching contact piece 14*a* and lower switching contact piece 14*b* rest on one another over an area, thus forming a flat contact and switching surface 28. In this position, the springs 33 have been moved to their compressed position via the stop ring 35. As soon as the moving contact plunger 17 has been moved to the position to form an isolation gap, the outer switching and contact surfaces 29 of the upper and lower switching contact pieces 14*a*, 14*b* are moved away from one another. The inner switching and contact surfaces 30 of the upper and lower switching contact piece 14*a*, 14*b* first of all, however, still remain resting on one another over an area, for as long as the drive force of the springs 33 which are now being unloaded is sufficient to move the plunger 34 to the moved-out position of the inner switching and contact surface 30, as illustrated in FIG. 14. When the contact plunger 17 now moves further away from the stationary contact 16, the inner switching and contact surfaces 30 of the lower and upper switching contact piece 14*a*, 14*b* now also move apart from one another, as a result of which the isolation gap is now formed. In the opposite situation, when the contact plunger 17 is moving toward the stationary contact 16, the inner switching and contact surfaces 30 first of all make contact with one another over an area, the inner switching and contact surfaces 30 are moved relative to the outer switching and contact surfaces 29 against the force of the springs 33 until the moved-in position of the inner switching and contact surfaces, as illustrated in FIG. 13, is reached, and therefore the contact position of the switching contact pieces 14*a*, 14*b* as illustrated in FIG. 3.

The outer switching and contact surfaces 29 are formed of material which has an annular shape and is highly conductive. This material is suitable for transmitting the rated current, which in each case has to be carried by the vacuum switch, with a very low resistance. In contrast, the inner switching and contact surfaces 30 are composed of a material which is in the form of a disk, has high strength and is particularly resistant to erosion and wear in order in this way to also be able to withstand and quench arc currents which occur for a short time. The springs 33, which are arranged underneath, are composed of material which can carry a short circuit current, for example a copper-tungsten alloy. In particular, the material of the outer switching and contact surfaces 29 is oxygen-free and is composed, for example, of a copper-silver alloy. By way of example, the material of the inner switching and contact surface 30 is composed of a copper-chromium alloy.

During disconnection, that is to say when the stationary contact 16 and the contact plunger 17 are being moved apart from one another, the outer switching and contact surfaces 29 are first of all moved apart from one another by a drive mechanism which acts on the drive or switching rod 11, while the inner switching and contact surfaces 30 are moved out of the initially uniform contact and switching surface 28 as a result of the pressure which is exerted by the springs 33 on the inner plunger 34, and carry the resultant short-circuit current during this process. During this process, the outward movement of the inner switching and contact surfaces 30 is matched such that they remain in contact with one another until a sufficient distance is formed between the outer switching and contact surfaces 29 that this prevents the arc which is struck/which occurs from jumping over onto the circular ring of the outer switching and contact surfaces 29. As the stationary contact 16 and the contact plunger 17 move further apart from one another, the inner switching and contact surfaces 30 are then also disconnected, as a result of which the resultant arc is then held only between these surfaces, and is quenched after reaching adequate separation.

Furthermore, the inner switching and contact surfaces 30 rest on supporting heads 32 which are a component of a spiral arrangement of contacts for supporting the inner switching and contact surface 30. This makes it possible to produce an axial magnetic field, by means of which even relatively large and strong arcs can be made into diffuse arcs. In this case, the inner plunger 34 comprises a configuration of web-like segments 37 on which the supporting heads 32 are arranged aligned with respect to one another like a spiral, with the supporting heads 32 being designed to be electrically conductive, and being connected.

The illustrations in FIGS. 12, 13 and 14 are only schematic and correspondingly simplified with regard to the function of the springs 33 and of the supporting heads 32, as well as their arrangement and configuration as spiral contacts, that is to say as contacts arranged in a spiral shape.

The insulator 18 is an insulator composed of ceramic material. The sheathing of the vacuum interrupter chamber 1 preferably comprises a casting-resin jacket or casting-resin housing composed of a silicone material or silicone casting resin.

Overall, the combination of the widely differing measures increases the life and the life cycle of a vacuum interrupter chamber, improves the isolation capability of the vacuum chamber 12 and of the vacuum interrupter chamber 1 overall, and thus results in the vacuum interrupter chamber 1 and therefore in a vacuum switch having a compact overall physical form, in which case, for the sake of completeness, it should be stated once again that the upper ceramic cylinder 2 and the lower ceramic cylinder 3 are composed of a gas-tight ceramic material since, otherwise, it would not be possible to maintain a vacuum in the vacuum chamber 12.

Even if this is not necessary for the vacuum switch according to the invention, because of the excellent isolation characteristics, this can nevertheless, if desired, be arranged in a switchgear assembly housing that is filled with insulating gas.

The invention claimed is:

1. A vacuum switch, having a moving switching unit which is arranged within a vacuum interrupter chamber and comprises a contact plunger, an insulator and a drive or switching rod which move with one another, which drive or switching rod is introduced into the vacuum interrupter chamber through a bellows composed of metal, and having a stationary contact which is inserted into the housing of the vacuum interrupter chamber, with a first end of the insulator being firmly connected to the contact plunger and with a second end of the insulator being firmly connected to the drive or switching rod, and with the contact plunger having a flexible electrically conductive connection to a conductor which makes an electrically conductive connection to at least one outgoer contact which is arranged at the side, wherein the stationary contact and the contact plunger each have a switching contact piece which has an outer switching contact surface and an inner switching contact surface which is movable relative thereto.

2. The vacuum switch as claimed in claim 1, characterized in that the inner switching contact surface is movable to a moved-out position, which is raised with respect to the outer switching contact surface, driven by the force of at least one spring.

3. The vacuum switch as claimed in claim 2, characterized in that the inner switching contact surface is movable out of the moved-out position to a position at the same height as the outer switching contact surface, driven against the force of at least one spring.

4. The vacuum switch as claimed in claim 2, characterized in that the moved-out position is designed such that, when the moved-out position is reached and the inner switching contact surfaces are resting on one another, the outer switching contact surfaces are separated by a distance which prevents any arc that occurs from jumping over onto the outer switching contact surfaces.

5. The vacuum switch as claimed in claim 1, characterized in that the inner switching contact surface is arranged on electrically conductive supporting heads, which are arranged like a spiral with respect to one another of an inner plunger.

6. The vacuum switch as claimed in claim 5, characterized in that at least one spring acts at one end on a stop or supporting ring of the inner plunger and acts at the other end on a base surface, which is formed in a mount body of at least one of the switching contact pieces.

7. The vacuum switch as claimed in claim 1, characterized in that the outer switching contact surface is composed of a layer of highly conductive material comprised of a copper-silver alloy, and the inner switching contact surface is composed of a layer of high-strength material which is resistant to wear and erosion, and which comprises a copper-chromium alloy.

* * * * *